US008460022B2

(12) United States Patent
Nguyen et al.

(10) Patent No.: US 8,460,022 B2
(45) Date of Patent: Jun. 11, 2013

(54) COLD-SHRINK SEPARABLE CONNECTOR

(75) Inventors: Nga K. Nguyen, Austin, TX (US); William L. Taylor, Round Rock, TX (US); Carl J. Wentzel, Austin, TX (US); Robert J. Schubert, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/771,641

(22) Filed: Apr. 30, 2010

(65) Prior Publication Data

US 2010/0279543 A1 Nov. 4, 2010

Related U.S. Application Data

(60) Provisional application No. 61/174,632, filed on May 1, 2009.

(51) Int. Cl.
*H01R 13/53* (2006.01)

(52) U.S. Cl.
USPC ..... 439/181

(58) Field of Classification Search
USPC ..... 439/181–187, 521, 921, 934, 932
See application file for complete search history.

(56) References Cited

U.S. PATENT DOCUMENTS

| | | | | |
|---|---|---|---|---|
| 3,888,559 | A | 6/1975 | Geib | |
| 4,053,702 | A | 10/1977 | Erickson et al. | |
| 4,571,018 | A | 2/1986 | Annoot | |
| 4,629,277 | A | 12/1986 | Boettcher et al. | |
| 4,714,438 | A * | 12/1987 | Williams | 439/607.51 |
| 5,230,640 | A | 7/1993 | Tardif | |
| 5,467,515 | A | 11/1995 | Luzzi | |
| 5,670,223 | A | 9/1997 | Sadlo et al. | |
| 5,844,170 | A | 12/1998 | Chor et al. | |
| 5,925,852 | A | 7/1999 | Hinz et al. | |
| 6,171,147 | B1 | 1/2001 | Nachbauer et al. | |
| 6,332,785 | B1 | 12/2001 | Muench, Jr. et al. | |
| 6,338,637 | B1 | 1/2002 | Muench, Jr. et al. | |
| 6,796,820 | B2 | 9/2004 | Jazowski et al. | |
| 6,905,356 | B2 | 6/2005 | Jazowski et al. | |
| 6,991,484 | B2 * | 1/2006 | Luzzi | 439/181 |
| 7,104,822 | B2 * | 9/2006 | Jazowski et al. | 439/181 |
| 7,304,242 | B1 | 12/2007 | Dower et al. | |
| 7,431,599 | B2 | 10/2008 | Luzzi | |
| 2005/0227522 | A1 | 10/2005 | Luzzi | |
| 2008/0156528 | A1 | 7/2008 | Campbell | |
| 2010/0200265 | A1 | 8/2010 | Lu et al. | |

FOREIGN PATENT DOCUMENTS

| | | |
|---|---|---|
| DE | 4432542 | 3/1996 |
| DE | 19742078 | 4/1999 |
| EP | 0911936 | 4/1999 |
| JP | 2002-152936 | 5/2002 |
| WO | WO 9531845 | 11/1995 |
| WO | WO 2009006136 | 1/2009 |
| WO | WO 2009035859 | 3/2009 |

OTHER PUBLICATIONS

Supplementary European Search Report for EP10770439, 6 pgs., Jan. 7, 2013.

* cited by examiner

*Primary Examiner* — Javaid Nasri
(74) *Attorney, Agent, or Firm* — Melanie G. Gover

(57) ABSTRACT

A cold-shrink article having a chamber with an enlarged interior section to prevent the collapse of an end of a support core placed in the chamber.

17 Claims, 3 Drawing Sheets

COLD-SHRINK SEPARABLE CONNECTOR

CROSS REFERENCE TO RELATED APPLICATIONS

The present application claims priority to U.S. Provisional Patent Application 61/174,632, filed May 1, 2009.

TECHNICAL FIELD

This invention relates to a cold-shrink cable termination system.

BACKGROUND

A cable termination system typically includes a cable terminated with a metallic lug (i.e., cable connector), the cable connector and end portion of the cable being inserted into the housing of a connecting device, the cable connector being connected to a mating device within the confines of the housing. The housing needs to form a tight seal around the end portion of the cable to prevent contamination or corrosion of the connection.

A problem that arises with cable termination systems is that the internal diameter of the housing has to be adapted to the diameter of the cable. Cable sizes vary so it's necessary to have either several connecting devices of different sizes, each being designed to fit exactly the diameter of the particular cable, or several adapters of different thicknesses, each adapter enabling the housing to be adapted to a cable of a given diameter. These solutions are costly because they require a large number of connecting devices or adapters to adapt to a whole range of cables.

Another known solution is to provide a cold-shrink housing that can be expanded over almost its entire length to receive cables having a range of diameters. When a cold-shrink housing is used, a removable support core is placed within a portion of the housing. The removable support core has an outer diameter that is larger than the inner diameter of the housing portion when it is in a relaxed state. The removable support core holds the housing in an expanded state until the cable end and lug are inserted into the housing. The core is then removed, allowing the cold shrink housing to tighten around the cable.

A problem with the cold-shrink cable termination system is that the end of the removable support core placed within the housing cannot withstand the excessive pressure placed upon them by the expanded housing and will often collapse. Prior art references have sought to address this problem by reinforcing the ends of the removable support core.

SUMMARY

The present invention seeks to address the issue of core collapse caused by the excessive pressure of an expanded housing. However, unlike prior art solutions, the present invention focuses on the housing rather than the core.

The present invention features a novel article comprising a cold-shrink housing having a first chamber that intersects with a second chamber, the first chamber having a generally cylindrical shape with an upper portion nearest the second chamber, the upper portion having a diameter greater than the diameter of the remainder of the first chamber.

An advantage of at least one embodiment of the present invention is that it reduces the amount of pressure exerted on an end of a cold-shrink support core inserted furthest into a connecting device housing, thereby reducing the likelihood of core collapse.

Another advantage of at least one embodiment of the present invention is that the semi-conductive layer on the interior of the first chamber of the connecting device makes intimate contact with the cable connector.

An advantage of at least one embodiment of the present invention is that the outer semi-conductive layer provides an integrated ground because it makes contact with the cable metallic ground layer.

An advantage of at least one embodiment of the present invention is that the cold-shrink connecting device eliminates the need for a cable adapter. This eliminates an electrical interface, which can fail.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1:
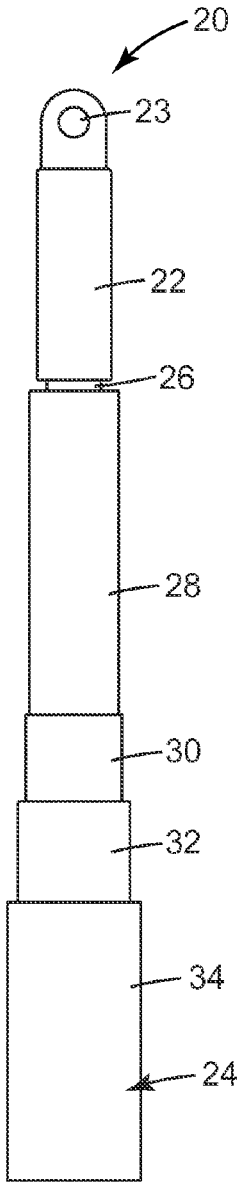
FIG. 1 depicts a typical cable assembly suitable for use with the present invention.

FIG. 1 shows a standard power cable assembly 20 which includes cable connector 22 attached to a cable 24. Cable 24 includes cable conductor 26 concentrically surrounded by cable insulation 28, cable insulation shield 30, cable metallic ground 32, and cable jacket 34. To form cable assembly 20, each of the cable insulation 28, cable insulation shield 30, cable metallic ground 32, and cable jacket 34 are stripped back from and end of cable 24 to expose a portion of the underlying layer, down to cable conductor 26. Cable connector 22 is then attached to the exposed portion of cable conductor 26 by any suitable means, typically by crimping.

Figure 2:
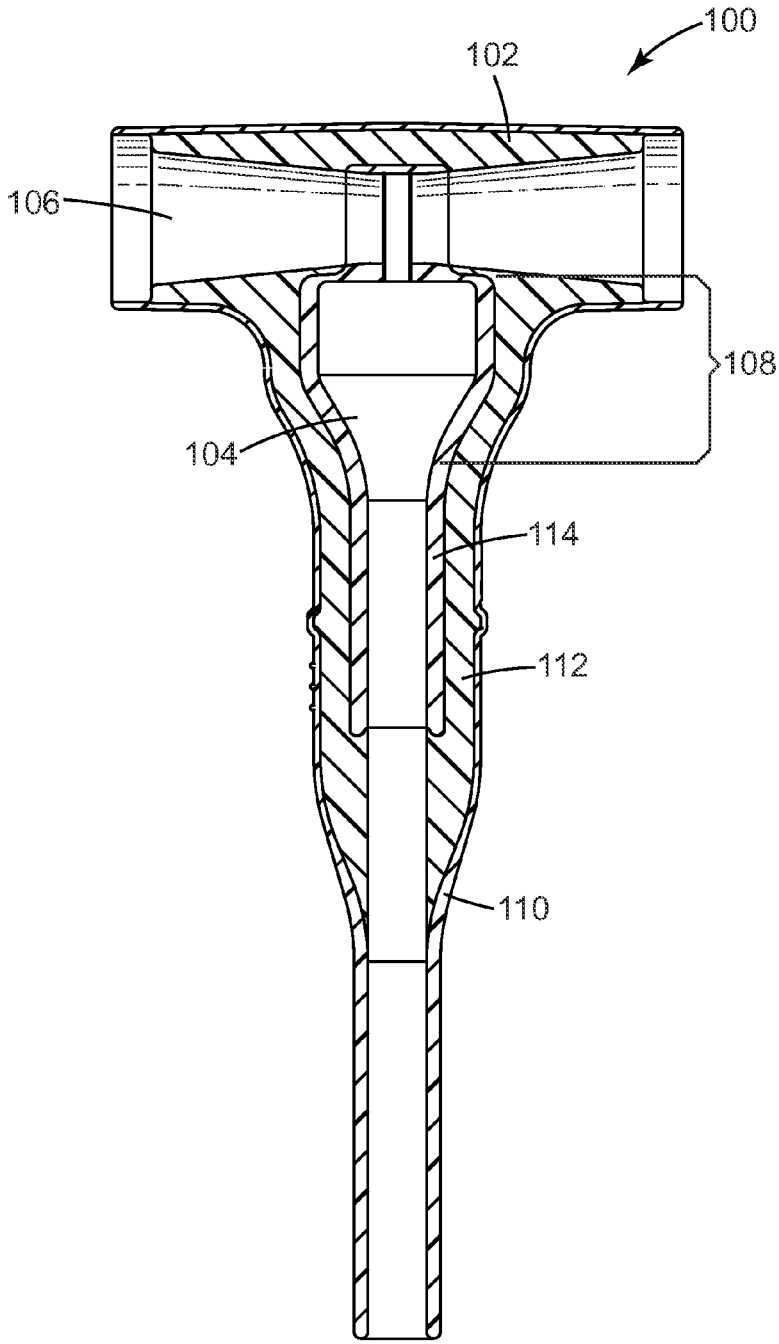
FIG. 2 depicts an embodiment of the connecting device of the present invention.

FIG. 2 shows connecting device 100 which includes housing 102 that generally defines first chamber 104 and second chamber 106. First chamber 104 and second chamber 106 intersect such that the interior of first chamber 104 is in communication with the interior of second chamber 106. First and second chambers 104,106 may intersect to form a general T-shape as shown in FIG. 2 or a general L-shape (not shown). First chamber 104 further includes an upper portion 108 located nearest to second chamber 106. As can be seen in FIG. 2, the inner and outer diameter of upper portion 108 of chamber 104 are larger than the inner and outer diameters of the remainder of first chamber 104. Housing 102 may further include an outer semi-conductive layer 110 and an intermediate insulating layer 112, with the interior wall of first chamber 104 being at least partially covered by inner semi-conductive layer 114.

Housing 102 may be made from any material suitable for cold-shrink applications. Most suitable are materials such as a highly elastic rubber material that has a low permanent set, such as ethylene propylene diene monomer (EPDM), elastomeric silicone, or a hybrid thereof. The semi-conductive and insulating materials may be made of the same or different types of materials. The semi-conductive and insulating materials may have differing degrees of conductivity and insulation based on the inherent properties of the materials used or based on additives added to the materials.

Figure 3:
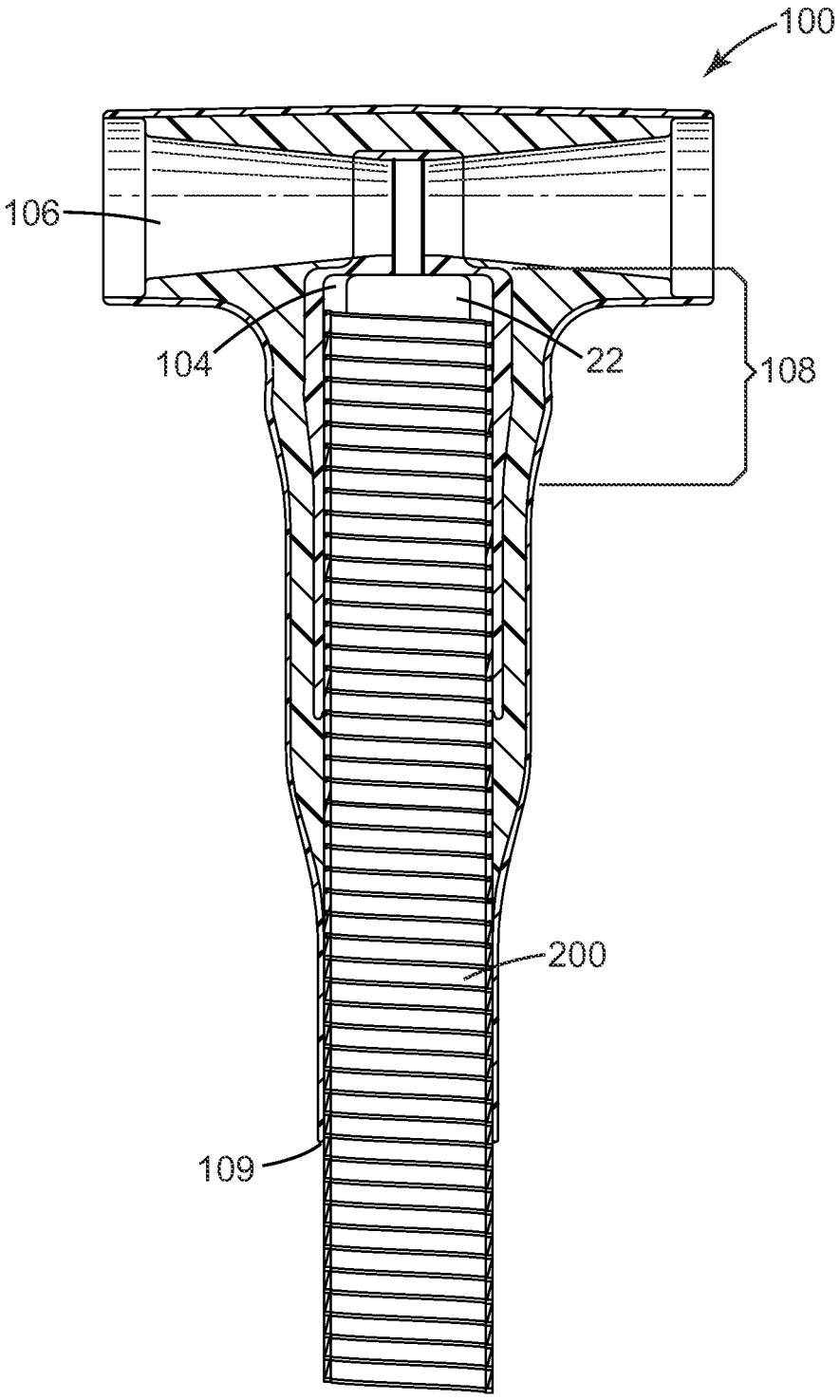
FIG. 3 depicts an embodiment of the connecting device of the present invention with a removable support core loaded in the connecting device.

To enable cable assembly 20 to be inserted into first chamber 104 of connecting device 100, a removable support support core 200 is first loaded into first chamber 104, as illustrated in FIG. 3. Once loaded, removable support support core 200 typically extends from the end of the upper portion 108 nearest the second chamber 106 to beyond the open end 109 of first chamber 104 through which cable assembly 20 is inserted. When loaded into first chamber 104, removable support support core 200 radially expands first chamber 104 to an inner diameter greater than the outer diameter of the largest portion of cable assembly 20 that will be inserted into first chamber 104.

Removable support support core 200 may be made of any suitable material and in any suitable configuration, but typically consists of an extruded nylon or propylene ribbon that is helically wound. To remove removable support support core 200 from first chamber 104, removable support support core is unraveled by pulling on a tab (not shown) extending from one end of the removable support support core 200 and causing separation of the core along the helical score line. Preferably, removable support core 200 is unraveled starting with the end in upper portion 108 nearest the second chamber 106 and ending with the end that extends beyond the open end 109 of first chamber 104. Unraveling removable support support core 200 in this manner prevent the open end 109 of first chamber 104 from prematurely collapsing and obstructing the removal of removable support support core 200.

When an end of a removable support support core is located in the interior of a chamber as in the present invention, it is possible that the pressure exerted by the expanded chamber on the end of the core in the chamber will cause the end of the removable support support core to collapse. The present invention addresses this issue by providing an upper portion 108 of the first chamber that has a larger inner and outer diameter than the remainder of the chamber. With this feature, the upper portion 108 of the first chamber is required to expand less than in a prior art connector devices not having this feature, and therefore, less pressure is exerted upon the end of the removable support core in the interior of the chamber, compared to similar prior art connector devices.

Preferably the inner diameter of the upper portion 108 of first chamber 104 is of a size in comparison to the outer diameter of a removable support core 200 inserted into first chamber 104 such that the maximum increase in the inner diameter of the upper portion 108 when removable support core 200 is loaded within first chamber 104 is less than 100%, and more preferably equal to or less than about 20% and greater than 0%, of the inner diameter absent removable support core 200 in first chamber 104.

The difference in inner diameter of the upper portion 108 and remainder of first chamber 104 will typically cause the upper portion 108 and the remainder of the first chamber to experience a differential increase in inner diameter when a removable support core is loaded into the first chamber. In other words, the inner diameter of the upper portion 108 will be required to increase less than the inner diameter of the remainder of the first chamber to accommodate a removable support core 200. This is particularly true when the removable support core 200 has a constant outer diameter, but may also be true when the removable support core has a tapered or stepped shape. Regardless of the shape of the removable support core 200, it is desirable that the outer diameter of the removable support core 200 is larger than the inner diameters of both the upper portion and the remainder of the first chamber in its relaxed state so that inner surface of the first chamber 104 exerts at least a sufficient amount of pressure on the removable support core 200 to keep it from dislodging from the first chamber 104. If the outer diameter of the removable support core 200 varies along its length, as with a tapered or stepped core, preferably the outer diameter of each portion of the removable support core 200 is greater than the inner diameter of the adjacent portion of the first chamber 104.

Preferably, the maximum increase in the inner diameter of the upper portion when a removable support core is loaded within the first chamber is between about 100% and about, but greater than, 0% of the inner diameter absent the removable support core in the first chamber and the maximum increase in the inner diameter of the remainder of the first chamber when a removable support core is loaded within the first chamber is between about 150% and about 300% of the inner diameter absent the removable support core in the first chamber.

Once the removable support core has been loaded into the first chamber 104, cable assembly 20 may be inserted into first chamber 104. Typically, cable connector 22 will include an aperture 23 at its free end. The free end is positioned in the intersection of the first and second chambers, 104, 106 with the remainder of the cable connector residing in the upper portion, and an adjacent portion of chamber, of first chamber 104. Once the cable assembly is correctly positioned, a stud (not shown) may be inserted through aperture 23 and one or more mating devices 42 may be inserted into second chamber 106 and attached to, or held in position against, cable connector 22 by the stud. Removable support core 200 may then be removed as described above to cause first chamber 104 to contract and form a tight seal around cable assembly 20.

Figure 4:
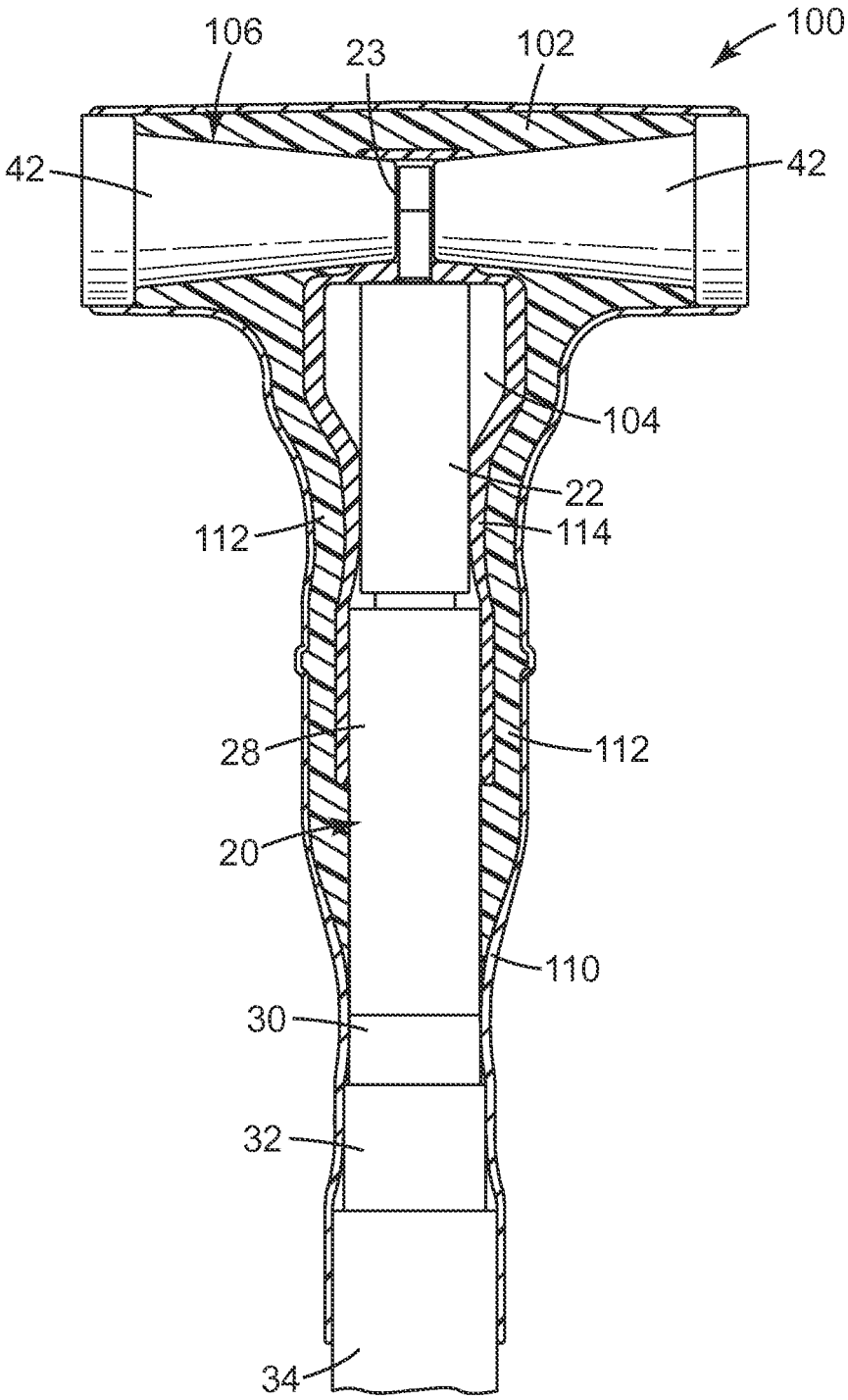
FIG. 4 depicts an embodiment of the connecting device of the present invention with a cable assembly in the connecting device.

As shown in FIG. 4, when the connecting device has been fully assembled, the inner semi-conducting layer 114 on the interior wall of the first chamber 104 of the housing 102 makes intimate contact with the cable connector 22 of cable assembly 20. Preferably, the inner semi-conducting layer 114 also makes intimate contact with the cable insulation 28 of cable assembly 20. A portion of the interior wall of first chamber 104 is made of the intermediate insulating layer 112. This portion preferably makes intimate contact with cable insulation 28. A portion of the interior wall of first chamber 104 is made of outer semi-conducting layer 110. This portion preferably makes intimate contact with cable insulation shield 30, and typically also makes intimate contact with cable metallic ground 32, which may be a tape or wire layer. The portion of the interior wall of first chamber 104 made of the outer semi-conducting layer 110 preferably also makes intimate contact with a portion of cable jacket 34 to prevent contaminants and/or moisture from entering the first chamber 104.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. This application is intended to cover any adaptations or variations of the preferred embodiments discussed herein. Therefore, it is manifestly intended that this invention be limited only by the claims and the equivalents thereof

What is claimed is:

1. An article comprising:

a cold-shrink housing comprising an inner semi-conductive layer, an intermediate insulating layer, and an outer semi-conductive layer, the housing having a hollow first chamber that intersects with a hollow second chamber, the hollow first chamber having a generally cylindrical shape defined by the inner semi-conductive layer, a portion of the intermediate insulating layer, and a portion of the outer semi-conductive layer, the hollow first chamber having an upper portion nearest the second chamber, the upper portion of the hollow first chamber being defined by an upper portion of the inner semi-conductive layer and having a diameter greater than the diameter of the remaining portion of the hollow first chamber.

2. The article of claim 1 wherein the first chamber and second chamber intersect to form an L-shaped opening.

3. The article of claim 1 wherein the first chamber and second chamber intersect to form a T-shaped opening.

4. The article of claim 1 wherein a maximum increase in the diameter of the upper portion of the hollow first chamber when a removable support core is loaded within the hollow first chamber is less than 100% of the diameter of the upper portion of the hollow first chamber absent the removable support core in the hollow first chamber.

5. The article of claim 4 wherein the maximum increase in the diameter of the upper portion of the hollow first chamber when the removable support core is loaded within the hollow first chamber is equal to or less than about 20% and greater than 0% of the diameter of the upper portion of the hollow first chamber absent the removable support core in the hollow first chamber.

6. The article of claim 1 wherein the upper portion of the hollow first chamber and the remaining portion of the hollow first chamber experience a differential increase in diameter when a removable support core is loaded into the hollow first chamber.

7. The article of claim 6 wherein a maximum increase in the diameter of the upper portion when a removable support core is loaded within the hollow first chamber is between about 100% and about, but greater than, 0% of the diameter of the upper portion of the hollow first chamber absent the removable support core in the hollow first chamber and the maximum increase in the diameter of the remaining portion of the hollow first chamber when a removable support core is loaded within the hollow first chamber is between about 150% and about 300% of the diameter of the remaining portion of the hollow first chamber absent the removable support core in the hollow first chamber.

8. The article of claim 1 further comprising a removable support core within the hollow first chamber, wherein the outer diameter of the removable support core is larger than the diameters of both the upper portion and the remaining portion of the hollow first chamber in its relaxed state.

9. The article of claim 8 further comprising a cable assembly in the hollow first chamber of the housing wherein the inner semi-conducting layer of the housing makes intimate contact with a connector portion of the cable assembly.

10. The article of claim 9 wherein the inner semi-conducting layer of the housing further makes intimate contact with a cable insulation portion of the cable assembly.

11. The article of claim 9 wherein the outer semi-conducting layer further makes intimate contact with a metallic ground of the cable assembly at the open end of the first chamber.

12. The article of claim 11 wherein metallic ground is a tape or wire layer.

13. The article of claim 8 wherein the outer semi-conducting layer of the housing makes intimate contact with an insulation shield portion of the cable assembly.

14. The article of claim 8 wherein the outer diameter of the removable support core varies along its length, and wherein the outer diameter of each portion of the support core is greater than the diameter of the adjacent portion of the hollow first chamber.

15. The article of claim 1 further comprising a cable assembly in the hollow first chamber of the housing.

16. The article of claim 1 wherein the housing comprises an elastomeric silicone.

17. The article of claim 16 wherein each of the outer semi-conductive layer, intermediate insulating layer, and inner semi-conductive layer comprise an elastomeric silicone.

* * * * *

UNITED STATES PATENT AND TRADEMARK OFFICE

CERTIFICATE OF CORRECTION

PATENT NO. : 8,460,022 B2
APPLICATION NO. : 12/771641
DATED : June 11, 2013
INVENTOR(S) : Nga K Nguyen It is certified that error appears in the above-identified patent and that said Letters Patent is hereby corrected as shown below:

In the Specification

Column 3

Line 18-19, Delete "support support" and insert -- support --, therefor.
Line 20, Delete "support support" and insert -- support --, therefor.
Line 25, Delete "support support" and insert -- support --, therefor.
Line 29, Delete "support support" and insert -- support --, therefor.
Line 32, Delete "support support" and insert -- support --, therefor.
Line 33, Delete "support support" and insert -- support --, therefor.
Line 35, Delete "support support" and insert -- support --, therefor.
Line 40, Delete "support support" and insert -- support --, therefor.
Line 43, Delete "support support" and insert -- support --, therefor.
Line 44, Delete "support support" and insert -- support --, therefor.
Line 48, Delete "support support" and insert -- support --, therefor.

Column 5

Line 7, Delete "thereof" and insert -- thereof. --, therefor.

Signed and Sealed this
Eighth Day of October, 2013

Teresa Stanek Rea

Teresa Stanek Rea
*Deputy Director of the United States Patent and Trademark Office*